US007624691B2

(12) United States Patent
Nordh

(10) Patent No.: US 7,624,691 B2
(45) Date of Patent: Dec. 1, 2009

(54) AIR NOZZLE WITH FASTENING MEANS AND METHOD FOR FASTENING OF SAID NOZZLE

(75) Inventor: Lennart Nordh, Gothenburg (SE)

(73) Assignee: Metso Power AB, Gothenburg (SE)

( * ) Notice: Subject to any disclaimer, the term of this patent is extended or adjusted under 35 U.S.C. 154(b) by 454 days.

(21) Appl. No.: 11/718,553

(22) PCT Filed: Nov. 14, 2005

(86) PCT No.: PCT/SE2005/001706

§ 371 (c)(1),
(2), (4) Date: May 3, 2007

(87) PCT Pub. No.: WO2006/054941

PCT Pub. Date: May 26, 2006

(65) Prior Publication Data

US 2008/0202394 A1 Aug. 28, 2008

(30) Foreign Application Priority Data

Nov. 19, 2004 (SE) ..... 0402831

(51) Int. Cl.

| | |
|---|---|
| ***F23G 5/00*** | (2006.01) |
| ***F23G 7/00*** | (2006.01) |
| ***C23F 11/16*** | (2006.01) |
| ***G01N 21/00*** | (2006.01) |
| ***G01N 31/22*** | (2006.01) |
| ***B05D 7/00*** | (2006.01) |
| ***F27B 15/00*** | (2006.01) |

(52) U.S. Cl. ..... 110/245; 432/15; 432/58; 427/213; 422/139; 422/143

(58) Field of Classification Search ..... 110/245, 110/243, 244, 263; 432/15, 58; 427/213; 422/139, 143; 239/DIG. 21, DIG. 22
See application file for complete search history.

(56) References Cited

U.S. PATENT DOCUMENTS

| | | | | |
|---|---|---|---|---|
| 2,797,907 | A * | 7/1957 | De Bie | 261/114.2 |
| 4,748,916 | A | 6/1988 | Nordh | |
| 5,286,188 | A * | 2/1994 | Barkley | 431/170 |
| 6,868,795 | B2 * | 3/2005 | Maryamchik et al. | 110/245 |
| 2004/0237858 | A1 | 12/2004 | Maryamchik | |

FOREIGN PATENT DOCUMENTS

| | | |
|---|---|---|
| DE | 4038341 | 6/1992 |
| GB | 1597118 | 9/1981 |
| GB | 2032590 | 3/2007 |

* cited by examiner

*Primary Examiner*—Kenneth B Rinehart
*Assistant Examiner*—David J Laux
(74) *Attorney, Agent, or Firm*—Rolf Fasth; Fasth Law Offices

(57) ABSTRACT

An air nozzle has an attachment arrangement for solid fuel burners with fluidized beds. The air nozzle has a body having an inlet and an outlet defined therein. A pipe end is inserted into the inlet. The attachment arrangement secures the pipe end inside the body. The attachment arrangement has a first part engaging a through hole of the body and a second perpendicular part that engages a cavity of the pipe end.

11 Claims, 6 Drawing Sheets

Fig. 4
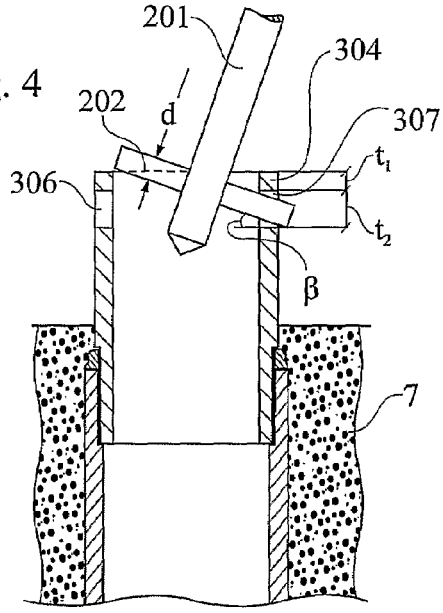
Fig. 5
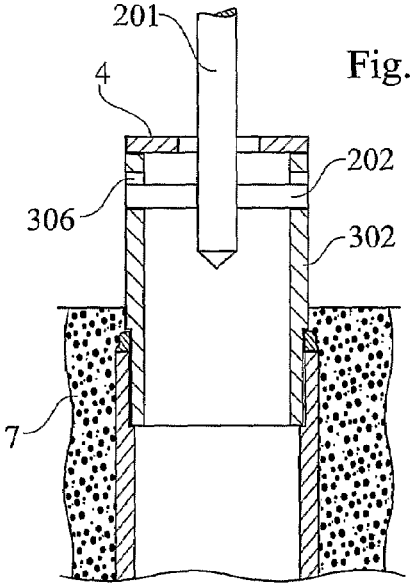
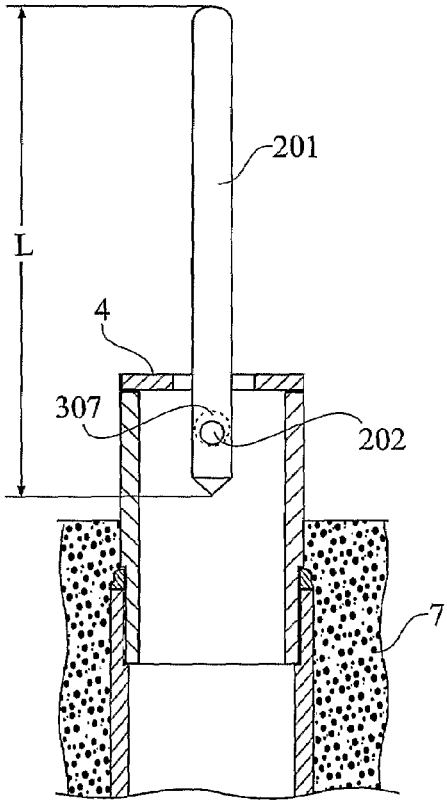
Fig. 6
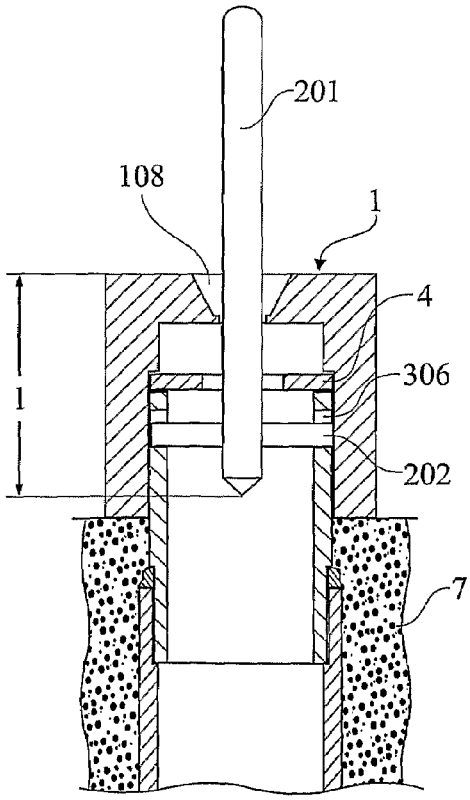
Fig. 7

Fig. 15
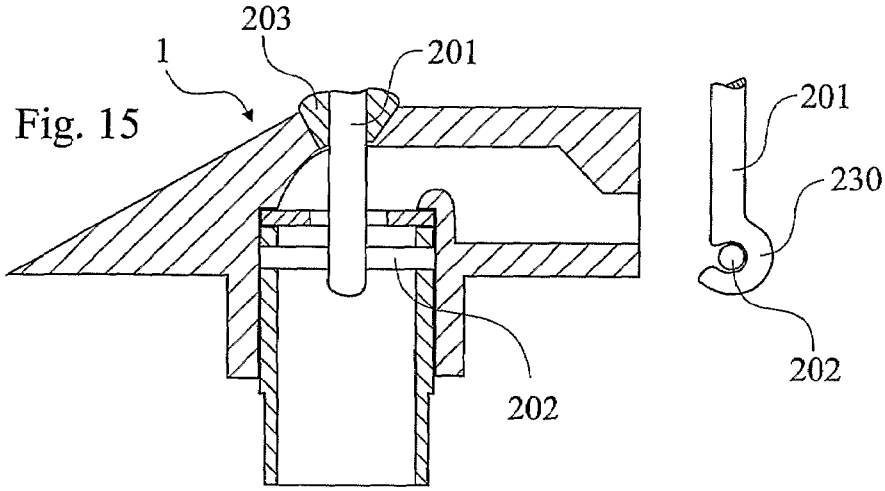
Fig. 16
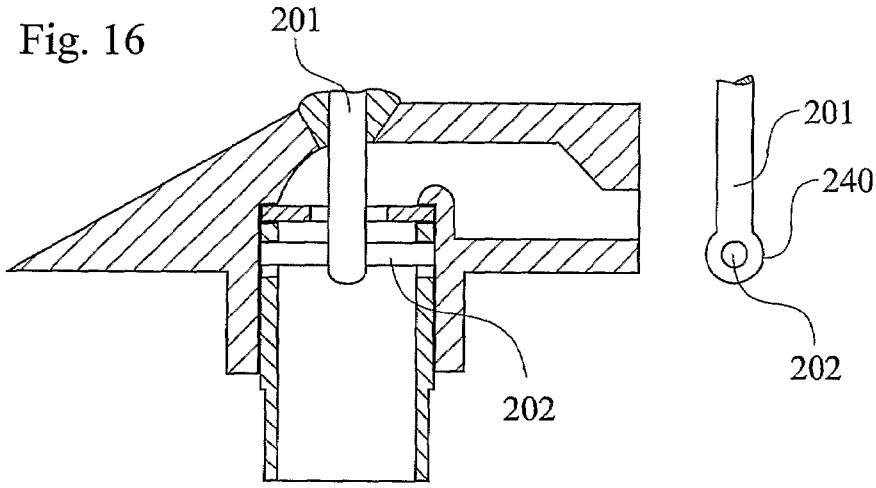
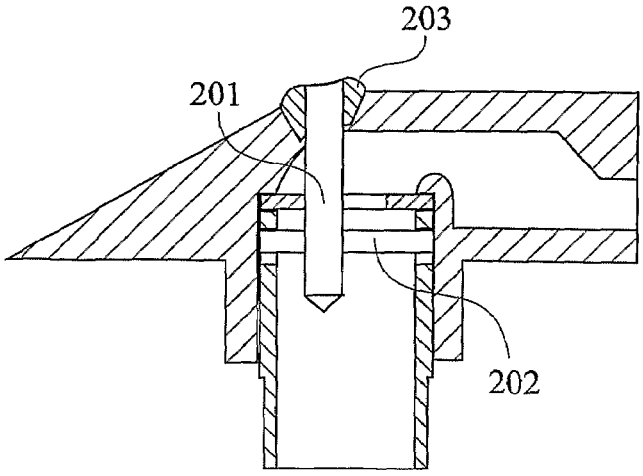
Fig. 17

AIR NOZZLE WITH FASTENING MEANS AND METHOD FOR FASTENING OF SAID NOZZLE

PRIOR APPLICATION

This application is a U.S. national phase application based on International Application No. PCT/SE2005/001706, filed 14 Nov. 2005, claiming priority from Swedish Patent Application No. 0402831-2, filed 19 Nov. 2004.

TECHNICAL AREA

The present invention concerns an air nozzle with attachment arrangement for solid fuel burners with fluidised beds, which air nozzle has a body with an upper surface, a lower surface and an air channel with an inlet arranged in the lower surface and at least one outlet arranged in at least one surface other than the bottom surface, whereby the said inlet is arranged to be united with a pipe end from a pipe system and whereby the said attachment arrangement is arranged to fix and to lock the nozzle at the said pipe end, which attachment arrangement comprises a first part that interacts with at least one through hole at the nozzle and a second part that interacts with at least one cavity at the said pipe end. The invention also concerns a method for the attachment of a nozzle.

THE PRIOR ART

A large number of air nozzles are used in solid fuel burners with fluidised beds in order to introduce the fluidising air that is required during the combustion. These air nozzles are subject to erosion and most often also to corrosion, which means that they must be exchanged quite often. According to currently known technology, such a nozzle is often attached by one or several of: welded joints between nozzle and air supply pipe, rivets, penetrating locking pins and screw joints. The attachment is achieved through, in the case of the welded joint, creating a weld in the interface between the nozzle and the air supply pipe; or by allowing the rivet, screw or locking pin to penetrate through the side walls of the nozzle, on opposing sides, such that the nozzle can in this way be connected with a pipe end that belongs to a pipe system for the supply of combustion air. An attachment method using rivets or similar requires high precision when handling the nozzle with the purpose of obtaining a sufficiently good fit. Not only must the internal surface be cut on a lathe whereby the length of the lathed section must have a tolerance of 0.1 mm with the aim of ensuring that the rivet holes in the nozzle and the pipe end fit together sufficiently accurately in a vertical direction, but also must the rivet holes that are applied in the nozzle be positioned with a high radial precision in order such that they are able to coincide with the two corresponding holes in the pipe end. It is now customary that an interpreter is used in order to check that the positions of the rivet holes are correctly positioned. It has proven to be the case that, despite the above-mentioned expensive measures (for attempting to obtain a high precision), it is often necessary to post-adjust by carrying out adjustment drilling with the nozzle in place, such that the rivets or connectors are able to be fitted in through the two holes. Such a nozzle and such an attachment method are described in SE 451093.

A further disadvantage of conventional nozzles and the associated attachment methods is that the direction of the nozzle relative to the pre-drilled holes in the pipe end to which the nozzle is to be applied is pre-determined. A further disadvantage is that disassembly in association with exchange of nozzle is a complex process. Freeing of the attachment means has in practice proven to be a complex process. A further disadvantage is that extremely hard materials that resist the severe environment are very difficult and expensive to process by drilling, milling or working on a lathe with the aim of achieving the dimensional tolerance that is required using conventional attachment technology.

BRIEF DESCRIPTION OF THE INVENTION

It is one aim of the present invention to eliminate or at least to reduce to a minimum the problems described above, something that is achieved with an air nozzle with an attachment arrangement for solid-fuel burners with fluidised beds, which air nozzle has a body with an upper surface, a lower surface and an air channel with an inlet arranged in the lower surface and at least one outlet arranged in at least one surface other than the bottom surface, whereby the said inlet is arranged to be united with a pipe end from a pipe system and whereby the said attachment arrangement is arranged to fix and to lock the nozzle at the said pipe end, which attachment arrangement comprises a first part that interacts with at least one through hole at the nozzle and a second part that interacts with at least one cavity at the said pipe end, whereby the said parts form a unit that does not have the form of a straight line, and that the said through hole is arranged to open at the said upper surface, and that a locking means at the said hole is arranged to fix the nozzle to the said first part.

Many advantages are achieved due to the invention. One important advantage is that assembly and disassembly become significantly more simple to carry out than they are when using conventional methods, due to the fact that the locking arrangement for the attachment arrangement is accessible from above. A second advantage is that the attachment arrangement makes it possible to fix the opening of the outlet in a desired position, when it is in place, independently of how interacting attachment arrangements at the pipe end have been positioned. A further advantage is that a nozzle according to the invention can be made with a lower requirement for processing and with lower requirements on the tolerances (than those required for conventional nozzles), something that leads to significant savings in cost.

The following conditions are valid according to preferred aspects of the invention:

- the said at least one cavity is constituted by a through hole, preferably in the form of a drilled hole, which gives the advantage that the cavity or the opposing hole can be arranged in a rational and simple manner,
- the said through hole is arranged with an extent that is significantly greater than the extent of the said second part along a corresponding direction, which gives the advantage that the said second part, i.e. the part that is to be applied transversely relative to the pipe with the through hole, can be positioned into the hole from the pipe end even though an angle ($\beta$) is formed during the insertion,
- the said pipe end is arranged with two cavities, whereby both are preferably constituted by through holes and one of the holes can have a configuration that deviates from that of the second hole, which achieves the advantage that a more stable counter-support is achieved for the attachment arrangement at the pipe end,
- the said second part comprises at least one section that extends essentially perpendicularly relative to the extent of the said first part, whereby the said second part preferably comprises two such sections, which achieves the advantage that it is possible to obtain in a simple manner effective counter-support between the attachment arrangement and the attachment means (such as, for example, the through hole), since it is now possible to arrange simply the opposing surfaces of the pipe end and the attachment arrangement. This becomes particularly advantageous when two such sections are used that preferably form in this case a T-shaped unit, the said first part and the said second part are constituted by an integrated unit, which preferably has the form of a "T", which achieves the advantage that the attachment arrangement is constituted by a unified unit, and which in certain cases also achieves advantages of cost, the said second part is integrated with the pipe end and that the said first part is arranged with a gripping element that it is intended should be able to grip around the said second part, which in certain cases achieves an advantage, since this allows a certain amount of freedom such that it is possible to adapt the interacting surfaces that are included in the attachment arrangement, and it also means the loose part of the attachment arrangement becomes less bulky.

DESCRIPTION OF DRAWINGS

The invention will be described in more detail below with reference to the attached drawings in which:

FIG. 4 shows a first stage during the attachment of a nozzle according to the invention, FIG. 5 shows the subsequent stage, FIG. 6 shows the same stage as that shown in FIG. 5 but from a perspective according to the section B-B in FIG. 5, FIG. 7 shows a stage before the actual final assembly, FIG. 15 shows an alternative design whereby a hook-shaped part of the attachment arrangement is used, FIG. 16 shows a further modification, and FIG. 17 shows a further modification according to the invention.

DETAILED DESCRIPTION

Figure 1:
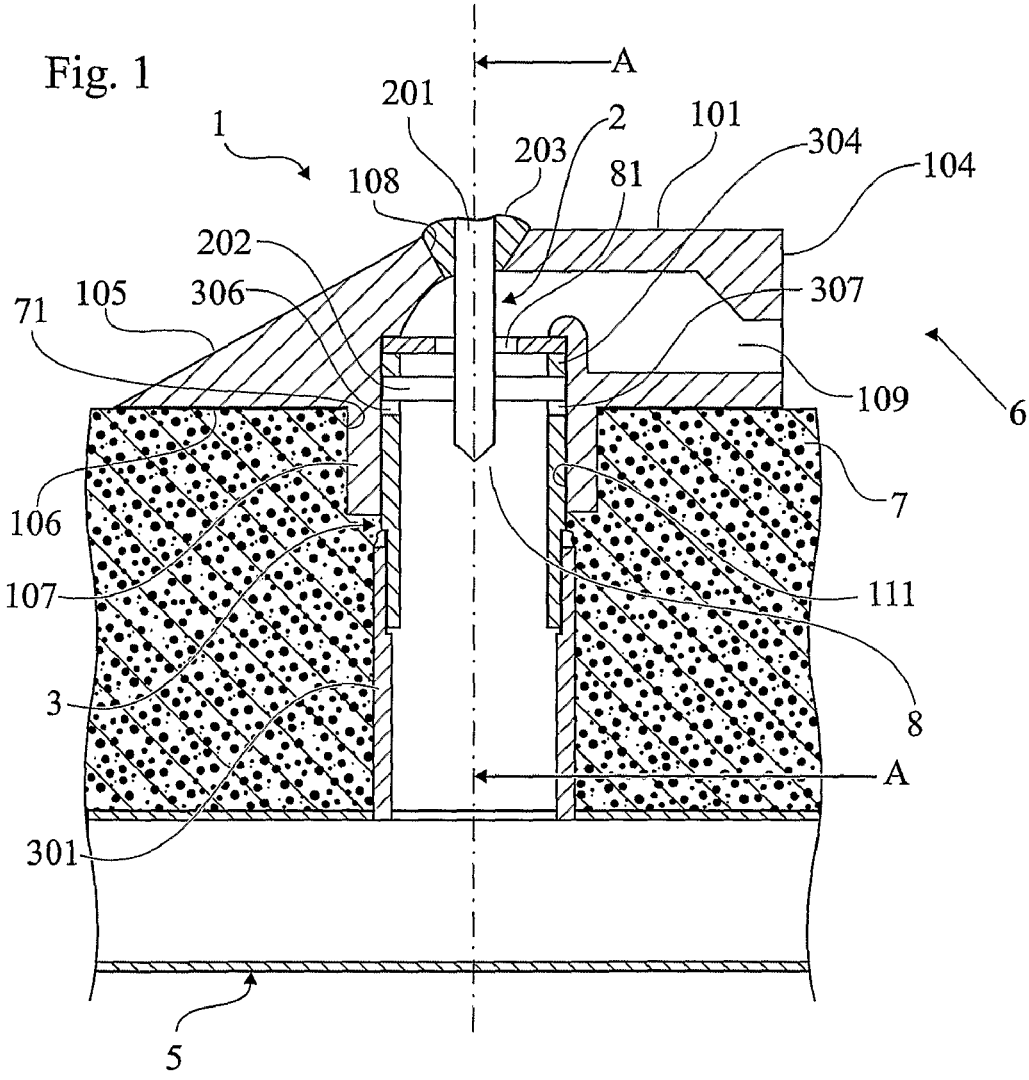
FIG. 1 shows a preferred design of a nozzle according to the invention, seen in a longitudinal cross-section.
Figure 2:
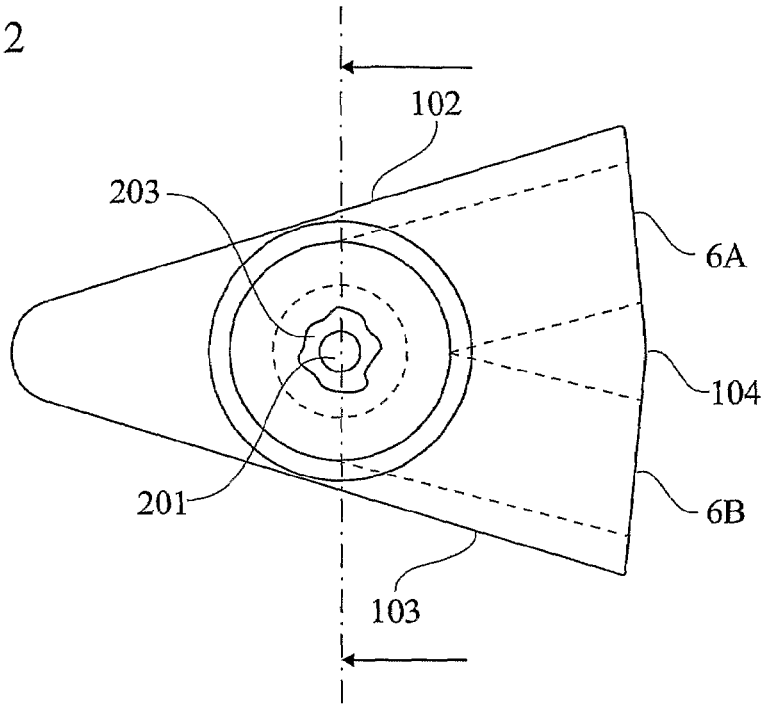
FIG. 2 shows the nozzle according to FIG. 1 seen from above.
Figure 3:
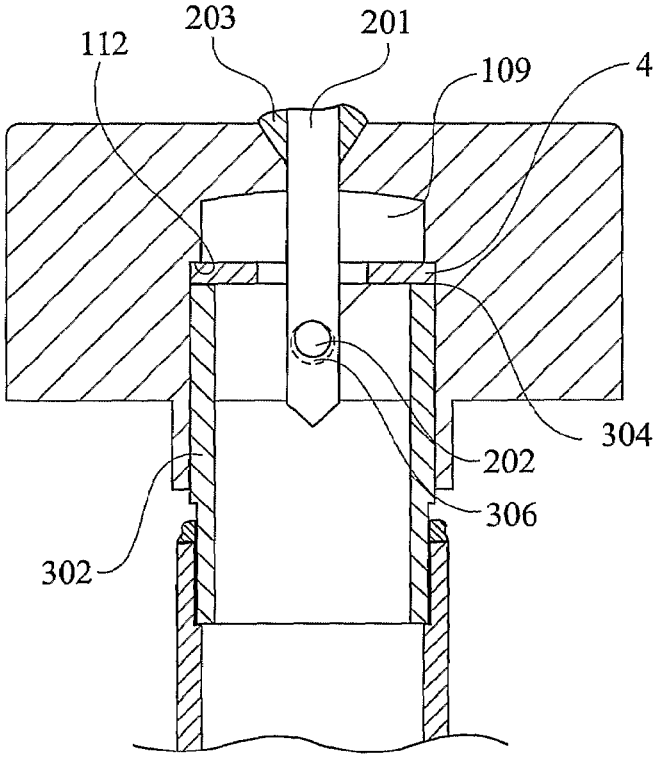
FIG. 3 shows the cross-section that is indicated by A-A in FIG. 1.

FIGS. 1, 2 and 3 show different views of one preferred embodiment of a nozzle 1 with an attachment arrangement 2 according to the invention. A nozzle 1 is shown, arranged on top of an end pipe 3 and attached there with the aid of an attachment arrangement 2. The end pipe 3 constitutes a branched outlet from a system 5 of pipes, normally what is known as a "wind box", the task of which is to supply air to a fluidised solid-bed burner. The nozzle 1 makes contact at its lower part 106 with a foundation 7 (it is appropriate that the foundation be bricked) of the solid fuel burner. Centrally positioned in the lower surface 106 is a ring-shaped spigot 107 that is located within a cavity 71 that has, in a corresponding manner, the form of a ring, between the bricked foundation 7 and the pipe 302. The nozzle 1 is arranged with an air channel 109, which takes air through an inlet 8 that is in connection with the said pipe end 3 out through an outlet opening 6. FIG. 2 shows that the nozzle 1 is advantageously arranged between two outlet openings 6A, 6B. The nozzle 1 is fixed to the pipe end with the aid of the attachment arrangement 2.

The attachment arrangement 2 comprises a T-shaped unit 201, 202 consisting of an rod-shaped first part 201, extended vertically in the drawing, with a relatively large diameter (preferably approximately 6-10 mm) and a rod-shaped second part 202, extended in itself horizontally, which is shorter and which may have a somewhat smaller diameter (preferably 4-8 mm). The second part 202 is arranged at the first part 201 by its fixation within a transverse hole 306-307 adapted for it, which hole is arranged close to the lower end of the first part 201. In the case in which the parts 201, 202 are manufactured as a single unit, by, for example, casting, they may have the same diameter.

The pipe end 3 consists according to the embodiment shown of a lower pipe section 301 that is attached to the wind box 5 by welding, and an upper section 302, which is, in turn, welded attached to the lower pipe section 301. There is arranged at the upper section 302 of pipe in the vicinity of its upper end 304 a first hole 306 and a second hole 307. The transverse part 202 of the T-shaped unit 201, 202 is arranged with its ends positioned within the holes 306, 307 in the pipe end 302. A throttle washer 4 is arranged above the pipe end 304, which washer ensures that the required area 81 of transport between the pipe end 3 and the air channel 109 is obtained. The upper surface of the throttle washer 4 lies in contact with an edge 112 that is arranged at the bottom of a cavity 111 that has been removed by lathe-work in the air nozzle 1. The vertical part 201 of the T-shaped unit 201, 202 protrudes upwards through the air nozzle 1 through a hole 108 that is arranged centrally (in the longitudinal direction) on the nozzle and in a region of the upper surface 101 of the nozzle 1, i.e. the surfaces 101, 105 of the nozzle that face essentially upwards. Fixation of the nozzle is achieved by locking by means of a weld 203 that unites the nozzle 1 with the vertical part 201 of the T-shaped unit 201, 202.

FIG. 2 shows that the nozzle 1 has a nearly triangular shape in a view from above, with two diverging side surfaces 102, 103 and an upper surface that comprises not only an essentially horizontal section 101 but also a tilted section 105. The openings 6A, 6B of the nozzles open in a direction away from the tilted surface 105, in a third side surface 104. This triangular design (which is in itself previously known) provides an advantageous dynamical form, in order, among other advantages, to minimise as far as possible the effect of erosion and to facilitate the transport of large particles in the fluidised bed towards the outlet.

FIGS. 4-7 show stage by stage the principle of how a nozzle according to the invention is assembled. In contrast to FIGS. 1-3, a modification is shown in which the pipe section 302 protrudes somewhat higher above the foundation 7, making in this manner the ring cavity 71 unnecessary.

FIG. 4 shows that the assembly begins with the introduction of one end of the transverse element 202 through one of the holes 307 in the end of the pipe 302. At this time it is the case that the hole 307 has a height $t_2$ that is sufficient to be able to receive the element 202 despite the angle $\beta$ with which the part 202 is introduced in through the hole 307. The angle $\beta$ depends on the distance $t_1$ between the upper edge of the hole 307 and the pipe end 304, the diameter d of the transverse element, and the inner diameter of the pipe 302.

The element 202 is displaced into the hole to a sufficient extent such that it is possible to obtain free passage at its opposite end, such that this can be lowered down into the pipe end 302, until it reaches a horizontal position (whereby the longer part 201 achieves a vertical position), after which the element 202 is displaced in a sideways direction until the transverse element 202 has been positioned such that each of its ends is located within a hole 306, 307 without protruding outside any one of these. This part of the attachment process is carried out by, for example, quite simply wiggling and pushing the T-shaped unit 201 by hand. The throttle washer 4 (see FIG. 5) is subsequently applied from above over the extended part 201, and it is placed against the upper end 304 of the end of the pipe 302.

FIG. 6 shows that same stage as that shown in FIG. 5, but now seen in a plane perpendicular to that in FIG. 5, whereby it is made clear that a sufficient height $t_2$ of one 307 of the holes is achieved by drilling this hole 307 with a significantly greater diameter $D=t_2$ than the diameter d of the transverse part 202.

FIG. 7 shows that the next stage of the assembly involves the nozzle 1 itself being placed over the extended part 201 by the introduction of this part 201 through the hole 108 until the bottom 106 of the nozzle 1 makes contact with the brick foundation 7 (and, where relevant, the sheath-shaped spigot 107 has fully penetrated the annular cavity 71 that is located in the bricked foundation around the pipe end 302). As FIG. 7 makes clear, the hole 108 is designed such that a V-weld can be simply applied in order to lock the nozzle 1 onto the extended part 201. Before the weld is made (a spot welding gun (not shown in the drawing) may be advantageously used) the T-shaped unit 201, 202 is drawn upwards whereby contact is obtained between the transverse element 202 and the upper edge sections of the holes 306 and 307. A welded joint can subsequently be formed in the gap between the extended part 201 and the hole 108. It is then simple for the assembler to complete a secure fixation by filling the complete gap with a weld 203.

A major advantage of the invention is that all assembly can be achieved with the accessibility at the upper surface of the nozzle 1. The assembler can obtain in this manner the best possible visibility and accessibility. A second major advantage is that the nozzle 1 can be freely rotated, for optimal determination of direction, after it has been positioned but before it is fixed in position with the aid of the first spot weld. The extruding part of the vertical part 201 of the T-attachment can be cut off when the welding has been completed (see FIG. 1).

The principle of arranging the vertical part 201 to have a significantly greater length L than the distance 1 up to the weld 203 allows the advantage to be gained that the protruding part can be used for easy gripping during the assembly.

There are several approaches that can be followed during disassembly of a nozzle according to the invention. One approach is that the nozzle is twisted off using tools, whereby the T-attachment 201, 202 breaks off or is deformed and loses its grip onto the pipe 302, such that the nozzle 1 can be subsequently exchanged for a new one. An alternative procedure is to use a cutting disk in order to make a cut in the upper part of the nozzle whereby the vertical part 201 of the T-attachment is cut. The nozzle can then be freely lifted away. A further alternative is to grind away the weld 203 that unites the T-attachment 201, 202 with the nozzle 1 and then lift off the nozzle 1. Removal of the nozzle can be carried out from above in all of the cases described without requiring any operation on the bricked foundation under the level of the nozzle, something that is a major advantage.

Figure 8:
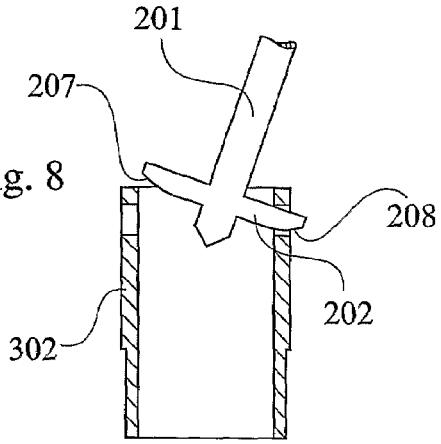
FIG. 8 and FIG. 9 show a modification according to FIGS. 4-7.
Figure 9:
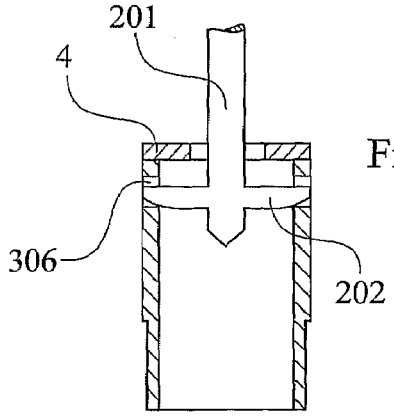

FIGS. 8 and 9 show an alternative design of the T-shaped element 201, 202 according to the invention, whereby the T-shaped element 201, 202 consists of an integrated unit and where the transverse element 202 is arranged with bevelled parts 207, 208 at the ends, something that may simplify introduction of the T-piece 201, 202 into the holes 306, 307 in the upper pipe end 302.

Figure 10:
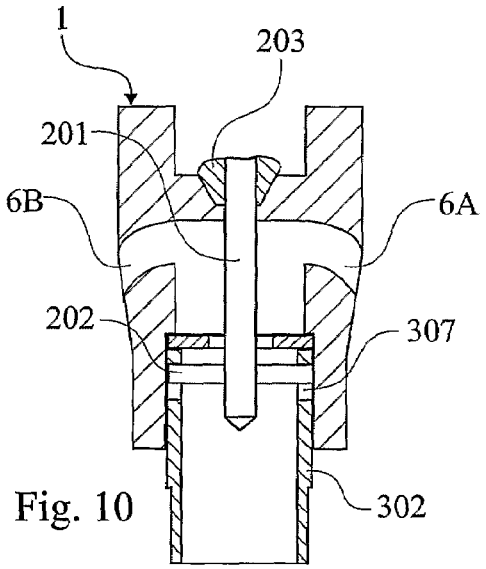
FIG. 10 shows a first alternative design of a nozzle according to the invention.

FIG. 10 shows that the invention can be advantageously used also when attaching what is known as mushroom nozzles 1 without having a bricked foundation arranged underneath.

Figure 11:
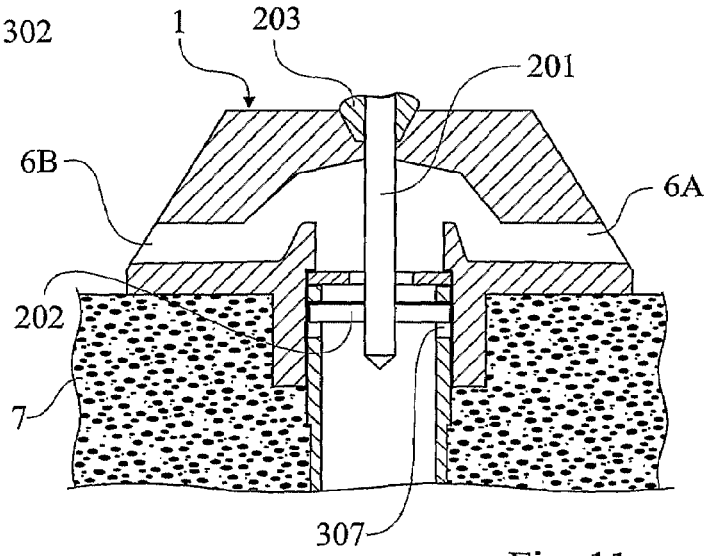
FIG. 11 shows a second alternative design according to the invention.

FIG. 11 shows that the invention can advantageously also be used for a mushroom nozzle 1 with a bricked foundation 7 underneath.

Figure 12:
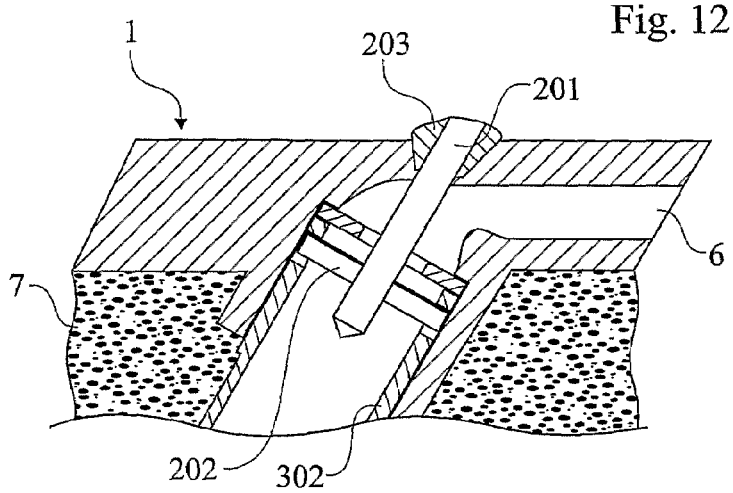
FIG. 12 shows a third alternative design.

FIG. 12 shows that the attachment arrangement according to the invention can also be advantageously used for a directed nozzle with brickwork 7 underneath.

Figure 13:
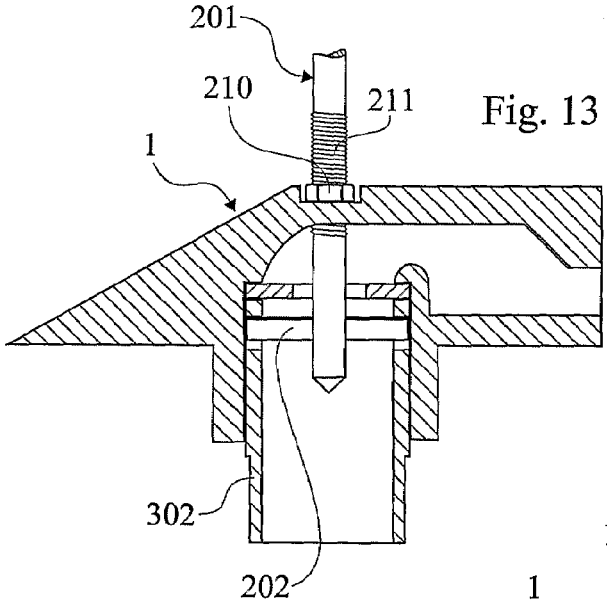
FIG. 13 shows a modification according to the invention, with attachment using nuts.

FIG. 13 shows that locking or fixation of the nozzle 1 can in certain cases be advantageously achieved by means of a nut 210 that is applied to the T-piece 201, 202, which is arranged in this case to have a threaded section 211.

Figure 14:
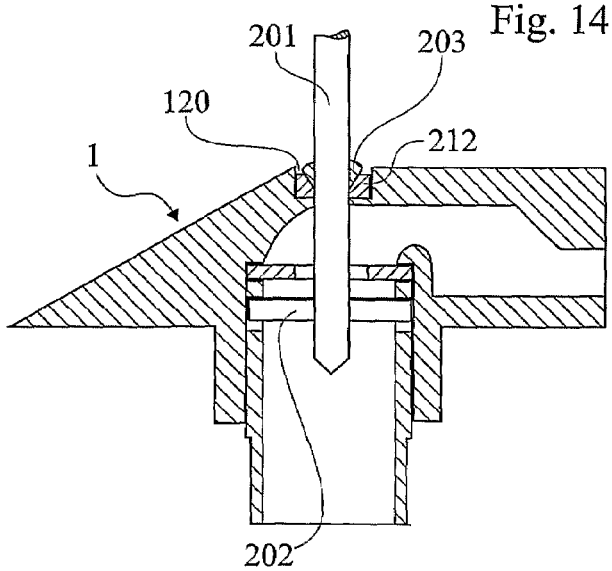
FIG. 14 shows a modification whereby welding and a washer are used for attachment.

FIG. 14 shows that locking or fixation of the nozzle 1 can be achieved by exploiting a washer 212 arranged within a milled out cavity 120, whereby the washer 212 is welded to the vertical part 201 of the T-shaped element 201, 202. This embodiment is particularly suitable, as is also that shown in FIG. 13, when the nozzle 1 is constructed from a material that is difficult to weld or one that tend to form cracks during welding, such as stellite.

FIG. 15 shows a modified design in which the transverse element 202 does not constitute an integral part of a T-piece: it is instead integrated with the upper part of the pipe end 302. An extended part 201 interacts with this transverse part 202, which extended part is arranged to have a hook-shaped device 230 at its lower end, adapted such that it can lock around the transverse element 202 when it is subject to a certain tension upwards. The attachment in principle otherwise takes place according to the description given above.

FIG. 16 shows also a modified design, whereby the T-shaped piece 201, 202 is designed in such a manner that the extended part 201 is designed to have an eye 240 at its end, into the hole of which eye the transverse element 202 is to be fixed.

FIG. 17 shows that the T-shaped piece 201, 202 also may be arranged such that the vertical part 201 is located asymmetrically.

The invention is not limited to what has been revealed above: it can be varied within the framework of the attached claims. One skilled in the arts will realise, for example, that the through holes 306, 307 that have been used to interact with the second part 202 of the attachment arrangement 2, can be varied within a broad framework while still fulfilling their basic function. It can, for example, be mentioned that one skilled in the arts will realise that it is not necessary to have through holes on both sides: it is sufficient to have one through hole on one side and a non-penetrating hole, or, quite simply, a counter-support arranged in another manner, on the opposite side. Furthermore, one skilled in the arts will realise that the basic principles according to the invention allow themselves defacto to be fully used without the arrangement of holes in the pipe end 302 by, for example, arranging an attachment point or a separate counter-support on the inner surface of the pipe end 302. In an extreme case, it is also possible to exploit the principle of the invention without a T-shaped piece, by arranging the extended vertical part 201 with a hook-shaped device at its lower end (see FIG. 15) that interacts with an adapted counter-support arranged on the inner surface of the pipe end 302. Thus, when using such a modification, the pipe end 302 does not have to be arranged with any through hole at all. However, creating holes is a rational and a simple operation, and this means that the use of drilled holes or cavities is often to be preferred. The precise design of the hole can also be varied within a wide framework. It may be advantageous, with the aim of reducing to a minimum the risk that the air nozzle can tilt around its vertical axis after it has been attached, to design holes that have an extent in the horizontal direction that is essentially exactly adapted to the extent in the horizontal direction of the transverse part 202 of the attachment arrangement 2. (It must be realised that the terms "vertical" and "horizontal" do not have a limiting significance: they are used in this description solely with the purpose of clarifying various parts such as they are presented in the drawings. One skilled in the arts will know that a nozzle in reality can be positioned with its "vertical axis" deviating markedly from a vertical line.) Thus, according to certain designs, a hole 307 with the form of a slit may be preferred, having a greater extent $t_2$ in the vertical direction than in the horizontal direction, which preferably corresponds essentially to the diameter d of the transverse element 202. It will be realised further that it is fully sufficient only to have one precisely adapted hole 306 on the opposite side, since this hole 306, in contrast to the second hole 307, is penetrated by the transverse element 202 when this is located aligned with the common axis of the two holes 306, 307. It will be further realised that also holes with a triangular design may be advantageously used on certain occasions, whereby convergent side surfaces are obtained, which may in certain case contribute to an effective fixation of the nozzle 1 with the attachment arrangement 2. In addition, it will be realised that also other cross-sectional profiles that circular, for example, square cross-sectional profiles, may sometimes be advantageously used for both the transverse element 202 and for the vertical element 201, and that combinations of different types of cross-sectional profile can be used for the different parts 201, 202.

While the present invention has been described in accordance with preferred compositions and embodiments, it is to be understood that certain substitutions and alterations may be made thereto without departing from the spirit and scope of the following claims.

The invention claimed is:

1. An air nozzle with attachment arrangement for solid fuel burners with fluidized beds, comprising:

a body having an upper surface and a lower surface, the lower surface of the body having an air channel with an inlet defined therein, the body having an outlet defined therein, the outlet being arranged in a surface of the body other than the lower surface, the body having a through hole defined therein, a pipe end of a pipe system inserted into the inlet of the body, the pipe end having a cavity defined therein, an attachment arrangement disposed in the body, the attachment arrangement being arranged to secure the body to the pipe end, the attachment arrangement comprising a first part interacting with the through hole of the body and a second part interacting with the cavity of the pipe end, the first part and the second part forming a unit that does not have a form of a straight line, the through hole being arranged to open at the upper surface of the body, and a locking device disposed in the through hole to secure the first part to the body.

2. The air nozzle according to claim 1, wherein the cavity of the pipe end is a through hole.

3. The air nozzle according to claim 2, wherein the through hole extends a longitudinal distance ($t_2$) that is greater than a thickness (d) of the second part.

4. The air nozzle according to claim 1 wherein the pipe end has a first cavity and a second cavity defined therein, the first cavity has a configuration different from a configuration of the second cavity.

5. The air nozzle according to claim 1 wherein the second part extends in a direction that is substantially perpendicular to the first part.

6. The air nozzle according to claim 1 wherein the first part and the second part are constituted by an integrated unit that is T-shaped.

7. The air nozzle according to claim 1 wherein the second part is integrated with the pipe end and the first part is arranged with a griping element to grip around the second part.

8. A method for attaching an air nozzle for solid fuel burners with fluidized beds, comprising:

providing a body with an upper surface and a lower surface, the lower surface of the body having an air channel with an inlet defined therein, the body having an outlet defined therein at a surface other than the lower surface, the body having a through hole defined therein at the upper surface, attaching a pipe end to the body at the inlet, the pipe end having a cavity defined therein, an attachment arrangement securing the pipe end to the body at the inlet thereof, the attachment arrangement comprising a first part in operative engagement with a second part of the attachment arrangement, the first part and the second part forming a unit that does not form a straight line, extending the first part into the through hole of the body, securing the first part to the body by locking means acting between the first part and the through hole of the body, and the second part engaging the cavity of the pipe end.

9. The method according to claim 8, wherein the method further comprises determining a direction of the outlet before the locking means is fixed.

10. The method according to claim 8 wherein the method further comprises arranging the first part to have a length (L) that is longer than a distance (l) between the second part and the upper surface (101).

11. The method according to claim 8 wherein the method further comprises securing the locking means by a weld.

* * * * *